US009368923B2

(12) United States Patent
O'Connor

(10) Patent No.: US 9,368,923 B2
(45) Date of Patent: Jun. 14, 2016

(54) ACTUATOR APPARATUS FOR POWERING USB RECEPTACLE AND METHODS OF MAKING AND USING THE SAME

(71) Applicant: Lawrence O'Connor, Austin, TX (US)

(72) Inventor: Lawrence O'Connor, Austin, TX (US)

(73) Assignee: New Concepts Development Corp., Woodstock, IL (US)

( * ) Notice: Subject to any disclaimer, the term of this patent is extended or adjusted under 35 U.S.C. 154(b) by 0 days.

(21) Appl. No.: 14/215,299

(22) Filed: Mar. 17, 2014

(65) Prior Publication Data

US 2015/0263461 A1 Sep. 17, 2015

Related U.S. Application Data

(60) Provisional application No. 61/794,324, filed on Mar. 15, 2013.

(51) Int. Cl.
*H01R 29/00* (2006.01)
*H01R 13/703* (2006.01)

(52) U.S. Cl.
CPC ..... *H01R 13/7036* (2013.01)

(58) Field of Classification Search
CPC ..... H01R 103/00
USPC ..... 439/188, 489, 660
See application file for complete search history.

(56) References Cited

U.S. PATENT DOCUMENTS

| | | | | |
|---|---|---|---|---|
| 7,963,794 | B2 * | 6/2011 | Chin et al. | 439/489 |
| 2004/0030818 | A1 | 2/2004 | Chen et al. | |
| 2007/0054550 | A1 | 3/2007 | Cuthbert et al. | |
| 2012/0045939 | A1 | 2/2012 | Pocrass | |

OTHER PUBLICATIONS

International Search Report and Written Opinion of the International Searching Authority for copending Int'l App. No. PCT/US14/30155.

* cited by examiner

*Primary Examiner* — Phuongchi T Nguyen
(74) *Attorney, Agent, or Firm* — Scherrer Patent & Trademark Law, P.C.; Stephen T. Scherrer; Monique A. Morneault

(57) ABSTRACT

The present invention relates to an apparatus for powering a USB socket, port or receptacle upon detecting the presence of a USB plug. More specifically, the present invention preferably provides an actuator that powers a USB receptacle upon insertion of a male USB plug therein.

7 Claims, 3 Drawing Sheets

ACTUATOR APPARATUS FOR POWERING USB RECEPTACLE AND METHODS OF MAKING AND USING THE SAME

The present invention claims priority under 35 U.S.C. §119 (d) to U.S. Provisional Pat. App. No. 61/794,324, titled "Actuator Apparatus for Powering USB Receptacle and Methods of Making the Same," filed Mar. 15, 2013, which is incorporated herein by reference in its entirety.

TECHNICAL FIELD

The present invention relates to an apparatus for powering a USB socket, port or receptacle upon detecting the presence of a USB plug. More specifically, the present invention preferably provides an actuator that powers a USB receptacle upon insertion of a male USB plug therein.

BACKGROUND

It is, of course, generally known to provide USB connections for providing power and communications through a USB cable to a peripheral electronic device that may be connected to a computer. Specifically, Universal Serial Bus (USB) is an industry standard developed in the mid-1990s that defines the cables, connectors and communications protocols used in a bus for connection, communication and power supply between computers and electronic devices.

USB was designed to standardize the connection of computer peripherals (including, but not limited to, keyboards, pointing devices, digital cameras, printers, portable media players, disk drives and network adapters) to personal computers, both to communicate and to supply electric power. It has become commonplace on other devices, such as smartphones, PDAs and video game consoles. USB has effectively replaced a variety of earlier interfaces, such as serial and parallel ports, as well as separate power chargers for portable devices.

In general, USB ports are utilized for transmitting power from one device to another and for allowing unilateral or bilateral communication between devices. Typically, USB standards allow for a 5V power supply, allowing anywhere from 100 mA to 1500 mA of current, depending on the USB standard version.

In many instances, unplugging a USB plug from a USB receptacle cuts off the power and communication flow through the USB port. However, in many cases, USB ports can be subject to so-called "vampire" electricity losses through electronic devices, which are typically small power drains where electricity can "leak" from the USB port. Although relatively small, the sheer number of USB devices in existence and in use means that the small amount of electricity drain through a USB port may be multiplied many times over, resulting in a large amount of lost electricity. Indeed, the sum of electricity leakage from all such USB ports becomes significant over the whole planet.

In addition, USB ports are meant to be utilized repeatedly, and to remain snug when a male USB plug is inserted into a female USB receptacle. However, after many, many uses of the USB plug, and repeated insertions of the male USB plug into the female USB receptacle, the connection may become loose, and lack resiliency to ensure that the male USB plug remains within the female USB receptacle.

A need, therefore, exists for a USB port whereby the power supplied therethrough is completely inactivated. Specifically, a need exists for an actuator apparatus for powering a USB port and methods of making and using the same.

In addition, a need exists for a USB port that prevents leakage of power when not in use. Moreover, a need exists for various actuators or switches that allow power through a USB port only when a male USB plug is inserted into a female USB receptacle and prevents electricity flow when a male USB plug is not present within the female USB receptacle.

Further, a need exists for a USB port having an actuator for providing power when a male USB plug is present that is sturdy and robust, and does not fail after repeated uses. Still further, a need exists for an actuator apparatus that further provides additional resistance to USB unplugging when in use.

SUMMARY OF THE INVENTION

The present invention relates to an apparatus for powering a USB socket, port or receptacle upon detecting the presence of a USB plug. More specifically, the present invention preferably provides an actuator that powers a USB receptacle upon insertion of a male USB plug therein.

To this end, in an embodiment of the present invention, a female USB receptacle comprises an inside surface and an actuator disposed on the inside surface thereof, the actuator activating power and communication through the female USB receptacle when a male USB plug is inserted into the female USB receptacle.

It is, therefore, an advantage and objective of the present invention to provide a USB port whereby the power supplied therethrough is completely inactivated.

Specifically, it is an advantage and objective of the present invention to provide an actuator apparatus for powering a USB port and methods of making and using the same.

In addition, it is an advantage and objective of the present invention to provide a USB port that prevents leakage of power when not in use.

Moreover, it is an advantage and objective of the present invention to provide various actuators or switches that allow power through a USB port only when a male USB plug is inserted into a female USB receptacle and prevents electricity flow when a male USB plug is not present within the female USB receptacle.

Further, it is and advantage and objective of the present invention to provide a USB port having an actuator for providing power when a male USB plug is present that is sturdy and robust, and does not fail after repeated uses.

Still further, it is an advantage and objective of the present invention to provide an actuator apparatus that further provides additional resistance to USB unplugging when in use.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE PRESENTLY PREFERRED EMBODIMENTS

The present invention relates to an apparatus for powering a USB socket, port or receptacle upon detecting the presence of a USB plug. More specifically, the present invention preferably provides an actuator that powers a USB receptacle upon insertion of a male USB plug therein.

Figure 1:
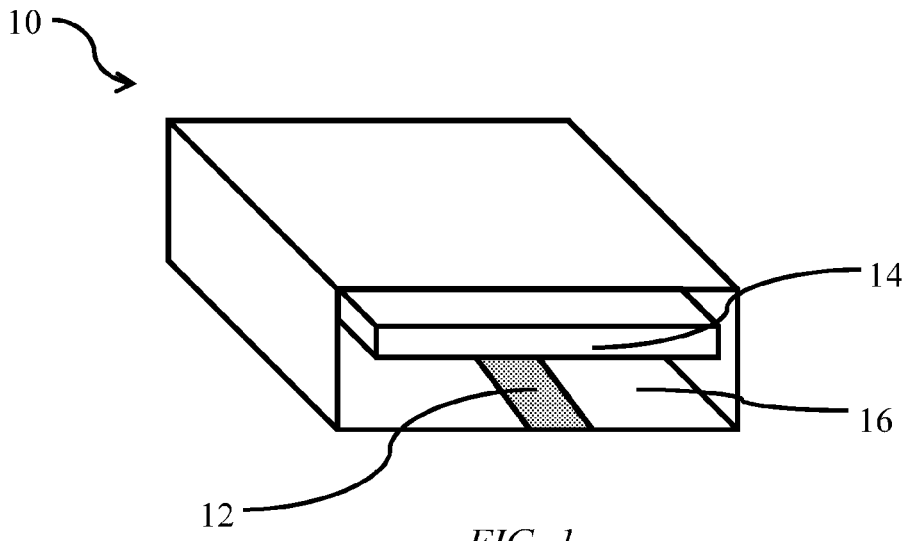
FIG. 1 illustrates a female USB receptacle having an actuator lever in an embodiment of the present invention.

Now referring to the figures, wherein like numerals refer to like parts, FIG. 1 illustrates a USB receptacle 10 having an actuator spring lever 12 disposed therein on a bottom surface 16 thereof. As is typical of a USB receptacle, or port, the USB receptacle 10 has an internal tongue 14, typically made from a plastic material, hosting a plurality of connectors thereon for connection with a USB male plug (20) that may be inserted therein.

Figure 2A:
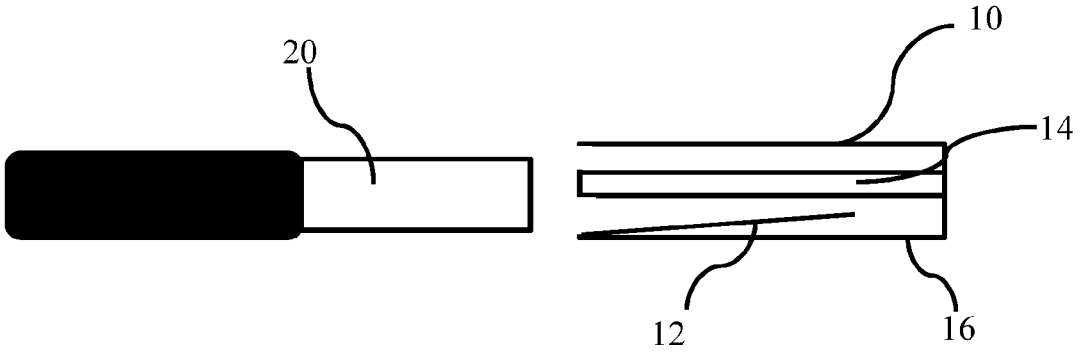
FIGS. 2A-2B illustrate insertion of a male USB plug into a female USB receptacle in an embodiment of the present invention.
Figure 2B:
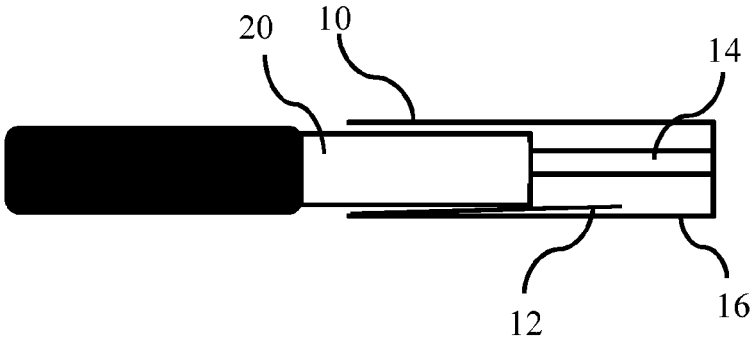

The actuator spring lever 12 may consist of a flange of resilient material, such as metal or the like, that may be connected to the bottom surface 16 near the opening of the USB receptacle, and angled upwardly toward the internal tongue 14. The lever 12 may be movable upwardly and downwardly at the connection point, such that when a male USB plug 20 is inserted into the USB receptacle 10, the lever 12 moves downwardly, as illustrated in FIGS. 2A and 2B.

When the male USB plug 20 is inserted into the female USB receptacle 10, thereby moving the lever 12 downwardly toward the bottom surface 16 of the female USB receptacle, the lever may act as a switch, activating the female USB receptacle 10 to allow the flow of power and communication therethrough. Likewise, when the male USB plug 20 is removed from the female USB receptacle 10, the lever 12 may move upwardly away from the bottom surface 16 of the female USB receptacle, de-activating the female USB receptacle 10, and preventing power and communication therethrough.

Figure 3:
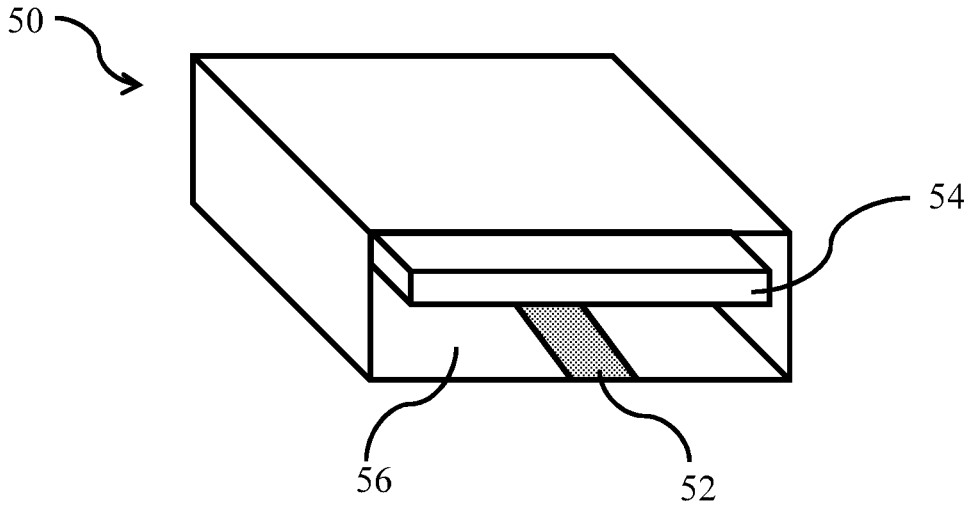
FIG. 3 illustrates a female USB receptacle having an actuator spring in an alternate embodiment of the present invention.

FIG. 3 illustrates an alternate embodiment of the present invention, of a female USB receptacle 50 having an actuator spring 52 disposed on a bottom surface 56 of the female USB receptacle 50. The actuator spring 52 may be angled upwardly toward a center of the bottom surface 56 until it reaches a zenith point 58, whereupon the actuator spring 52 may then be angled downwardly toward the rear 59 of the female USB receptacle 50. Disposed beneath the zenith point 58 of the actuator spring 52 may be an actuator element 57 that may move upwardly and downwardly within a slot 55 through the bottom surface 56 of the female USB receptacle.

Figure 4A:
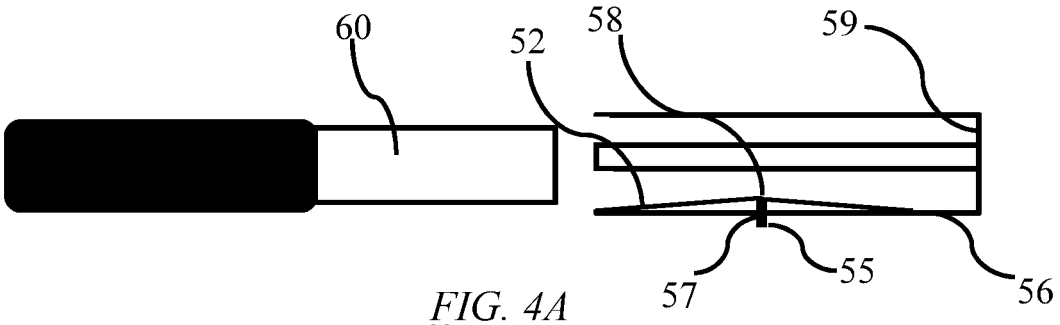
FIGS. 4A-4C illustrate insertion of a male USB plug into a female USB receptacle in an alternate embodiment of the present invention.
Figure 4B:
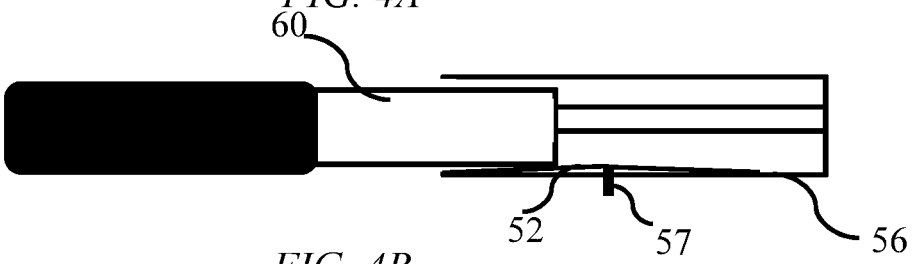
Figure 4C:
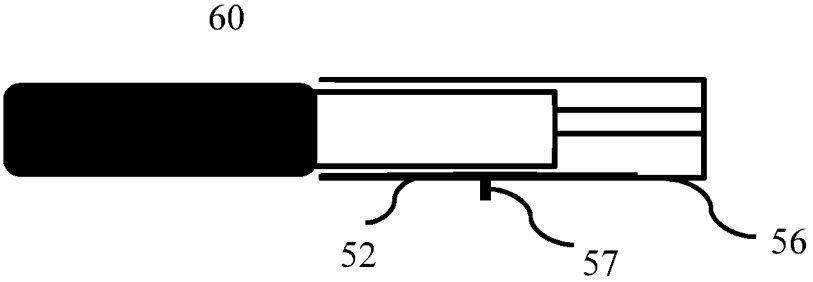

As illustrated in FIGS. 4A-4C, a male USB plug 60 may be inserted into the female USB receptacle 50. Upon insertion, the actuator spring 52 may be depressed and the actuator element 57 may move downwardly through the slot 55, which may trigger activation of the female USB receptacle to allow power and communication therethrough. Likewise, when the male USB plug 60 is removed from the female USB receptacle, the actuator spring 52 may return to its initial position, lifting the actuator element 57 upwardly causing the female USB receptacle to de-activate.

Figure 5:
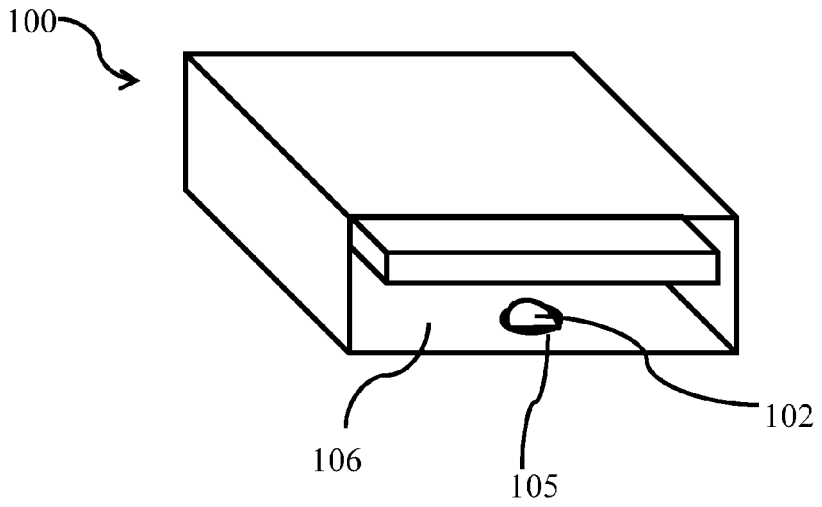
FIG. 5 illustrates a female USB receptacle having an actuator ball in an alternate embodiment of the present invention.

Now referring to FIG. 5, an alternate embodiment of a female USB receptacle 100 is illustrated. The female USB receptacle 100 may include an actuator ball 102 that may sit within an aperture 105 within the bottom surface 106 of the female USB receptacle 100. Upon insertion of a male USB plug 110, the actuator ball 102 may be pressed downwardly into a chamber 112 disposed beneath the female USB receptacle 100.

Figure 6A:
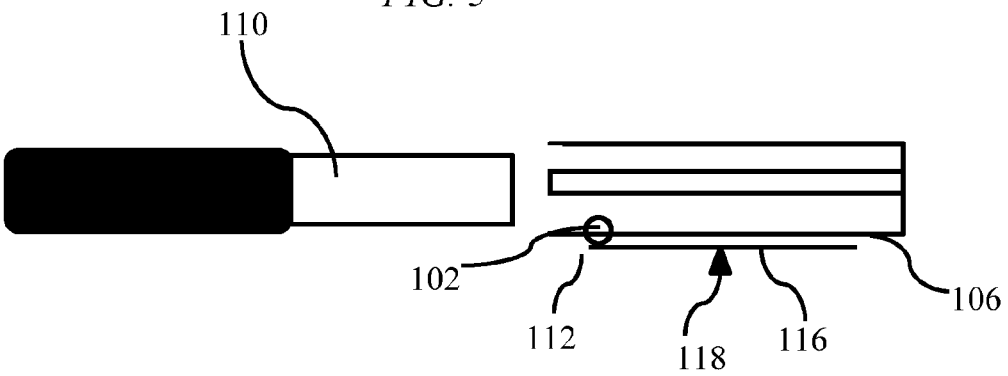
FIGS. 6A-6B illustrate insertion of a male USB plug into a female USB receptacle in an alternate embodiment of the present invention.
Figure 6B:
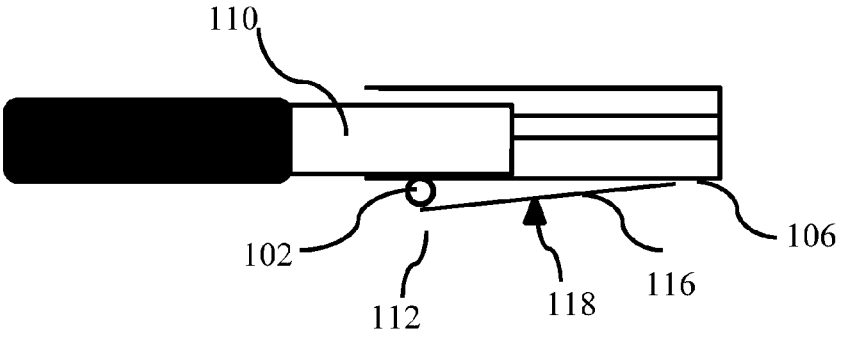

As illustrated in FIGS. 6A and 6B, the actuator ball 102 may sit within a collar 114 attached to an actuator lever 116 that may traverse the chamber 112. A fulcrum 118 may be disposed at a midpoint beneath the actuator lever 116, such that movement of the actuator ball 102 downwardly causes the actuator lever 116 to move upwardly on a distal end thereof, causing an activation of the female USB receptacle 100 via direct electrical connection or mechanical movement of a switch to activate the female USB receptacle 100. The actuator lever 116 may be spring-loaded such that movement of the male USB plug 110 out of the female USB receptacle 100 may cause the actuator ball 102 to rise through the aperture 105.

In the embodiments provided herein, which are merely exemplary and illustrate several preferred examples of the function of the present invention, the apparatuses described for activating and de-activating the female USB receptacles 10, 50, 100 may provide increased resistance for the male USB plug when disposed therein. USB plugs are frequently moved in and out of female USB receptacles, and the apparatuses of the present invention provide additional plug resistance ensuring that the USB ports remain connected as desired.

It should be noted that various changes and modifications to the presently preferred embodiments described herein will be apparent to those skilled in the art. Such changes and modifications may be made without departing from the spirit and scope of the present invention and without diminishing its attendant advantages.

I claim:

1. A female USB receptacle apparatus comprising:

an inside surface; and a mechanical actuator switch disposed on the inside surface thereof, the actuator switch electrically tied to a power circuit for powering the female USB receptacle comprising a movable element having a spring and configured to move from a first position to a second position, wherein the power circuit is off when the element is in the first position and wherein the power circuit is on when the element is in the second position, activating power and communication through the female USB receptacle when a male USB plug is inserted into the female receptacle thereby moving the spring-loaded movable element from the first position to the second position, and wherein the actuator deactivating power and communication through the female USB receptacle when the male USB plug is removed from the female receptacle thereby moving the spring-loaded movable element from the second position to the first position via the spring.

2. The female USB receptacle apparatus of claim 1 wherein the mechanical actuator switch comprises a spring lever.

3. The female USB receptacle apparatus of claim 1 wherein the mechanical actuator switch is a spring lever, and the power and communication is activated through the female USB receptacle when the lever contacts the inside surface.

4. The female USB receptacle apparatus of claim 1 wherein the movable element is a ball within a collar, wherein insertion of the male USB plug causes the actuator ball to move from the first position to the second position, activating power and communication through the female USB receptacle.

5. The female USB receptacle apparatus of claim 4 further comprising:

a lever contacting the ball, wherein movement of the ball caused by insertion of the male USB plug causes the lever to activate power and communication through the female USB receptacle.

6. The female USB receptacle apparatus of claim 5 further comprising:

a fulcrum disposed at a midpoint beneath the lever, wherein movement of ball caused by insertion of the male USB plug causes the lever to move against the fulcrum, causing the lever to activate power and communication through the female USB receptacle.

7. The female USB receptacle apparatus of claim 5 wherein the spring is in communication with the lever, wherein removal of the male USB plug causes the spring to move the lever and the actuator ball, deactivating the power and communication through the female USB receptacle.

* * * * *